US008986019B2

(12) United States Patent
Hartog et al.

(10) Patent No.: US 8,986,019 B2
(45) Date of Patent: Mar. 24, 2015

(54) CONNECTOR WITH AIR EXTRACTION

(71) Applicant: ASM IP Holding B.V., Almere (NL)

(72) Inventors: den Edwin Hartog, Almere (NL); de Chris G.M. Ridder, Almere (NL)

(73) Assignee: ASM IP Holding B.V., Almere (NL)

( * ) Notice: Subject to any disclaimer, the term of this patent is extended or adjusted under 35 U.S.C. 154(b) by 108 days.

(21) Appl. No.: 13/867,257

(22) Filed: Apr. 22, 2013

(65) Prior Publication Data

US 2014/0315396 A1 Oct. 23, 2014

(51) Int. Cl.
*H01R 13/60* (2006.01)
*H01R 13/00* (2006.01)

(52) U.S. Cl.
CPC ..... *H01R 13/005* (2013.01)
USPC ..... 439/41; 439/190

(58) Field of Classification Search
CPC ..... B60L 11/1818; H01R 2201/26
USPC ..... 439/190, 198, 205, 206, 41, 42
See application file for complete search history.

(56) References Cited

U.S. PATENT DOCUMENTS

| | | | | | |
|---|---|---|---|---|---|
| 3,588,781 | A * | 6/1971 | Williams | 39/41 |
| 4,061,969 | A * | 12/1977 | Dean | 324/756.07 |
| 4,108,528 | A * | 8/1978 | Long et al. | 439/42 |
| 4,209,745 | A * | 6/1980 | Hines | 324/755.05 |
| 4,230,985 | A * | 10/1980 | Matrone et al. | 324/750.25 |
| 4,232,928 | A * | 11/1980 | Wickersham | 439/42 |
| 4,322,682 | A * | 3/1982 | Schadwill | 324/750.25 |
| 4,344,033 | A * | 8/1982 | Stowers et al. | 324/754.16 |
| 4,352,061 | A * | 9/1982 | Matrone | 324/754.14 |
| 4,427,250 | A * | 1/1984 | Hines et al. | 439/296 |
| 4,536,051 | A * | 8/1985 | Smith et al. | 439/190 |
| 4,573,009 | A * | 2/1986 | Fowler et al. | 324/750.25 |
| 4,573,756 | A * | 3/1986 | Smith et al. | 439/42 |
| 4,643,501 | A * | 2/1987 | Coffin | 439/132 |
| 4,780,086 | A * | 10/1988 | Jenner et al. | 439/42 |
| 4,818,238 | A * | 4/1989 | Borg | 439/42 |
| 4,842,526 | A * | 6/1989 | Stukalin et al. | 439/42 |
| 4,912,400 | A * | 3/1990 | Plante | 324/750.16 |
| 5,478,245 | A * | 12/1995 | Okada et al. | 439/41 |
| 5,759,046 | A * | 6/1998 | Ingraham et al. | 439/42 |
| 6,254,410 | B1 * | 7/2001 | Sugiyama et al. | 439/158 |
| 6,471,522 | B2 * | 10/2002 | Kendall | 439/42 |
| 6,488,543 | B2 | 12/2002 | Oliphant | |
| 6,590,381 | B1 * | 7/2003 | Iino et al. | 324/750.2 |
| 7,445,528 | B1 | 11/2008 | Kuzma | |
| 8,366,466 | B2 * | 2/2013 | Hashimoto et al. | 439/206 |
| 8,502,499 | B2 * | 8/2013 | Xiao et al. | 320/109 |
| 8,529,273 | B2 * | 9/2013 | Maegawa | 439/34 |
| 8,662,910 | B2 * | 3/2014 | Ichio et al. | 439/206 |
| 8,827,731 | B2 * | 9/2014 | Sasaki et al. | 439/206 |
| 2002/0086560 | A1 * | 7/2002 | Kendall | 439/42 |
| 2010/0184304 | A1 * | 7/2010 | Ekstrom | 439/41 |
| 2011/0095779 | A1 * | 4/2011 | Washio et al. | 324/756.05 |

(Continued)

*Primary Examiner* — Ross Gushi

(74) *Attorney, Agent, or Firm* — Lexyoume IP Meister, PLLC

(57) ABSTRACT

An electrical connector a semiconductor processing tool is provided. The electrical connector comprises a male connector part having pins and a first holder in which the pins are mounted and a female connector part having sockets and a second holder in which the sockets are mounted. The male connector part is configured to mate with the female connector part, and at least one of the male connector part and the female connector part has an air extraction conduit of which one end communicates with a vacuum pump and the other end communicates with a space formed between the male connector part and the female connector part.

10 Claims, 3 Drawing Sheets

(56) References Cited

U.S. PATENT DOCUMENTS

| | | | | |
|---|---|---|---|---|
| 2011/0207368 | A1* | 8/2011 | Takada et al. | 439/519 |
| 2011/0230094 | A1* | 9/2011 | Takada | 439/589 |
| 2012/0003861 | A1* | 1/2012 | Kwasny et al. | 439/474 |
| 2012/0231644 | A1* | 9/2012 | Kinoshita | 439/205 |
| 2012/0258617 | A1* | 10/2012 | Osawa | 439/205 |
| 2012/0295460 | A1* | 11/2012 | Ichio et al. | 439/205 |
| 2012/0315801 | A1* | 12/2012 | Kwasny et al. | 439/695 |
| 2013/0052853 | A1* | 2/2013 | Natter et al. | 439/345 |

* cited by examiner

CONNECTOR WITH AIR EXTRACTION

BACKGROUND (a) Technical Field

This disclosure relates to the field of semiconductor processing and more in particular to connectors to be used in a clean environment (b) Description of the Related Art In semiconductor processing, vertical furnaces are used for batch processing of wafers. In such furnaces, a boat holding a vertical stack of wafers, accommodated in a wafer boat, the wafer boat being supported on a door plate is inserted into the furnace from below. The door plate may be provided with provisions such as a boat rotation mechanism, door plate heating and temperature sensors. These provisions require electrical connections. In the art, such a connection is made through a long flexible cable that hangs in a loop so as to allow for the vertical up and down movement of the door plate. This implies that a significant length of the cable is exposed to an environment immediately below the furnace. As the wafers to be processed are exposed to this environment, this environment is a mini-environment required to maintain clean air circulation. Into this mini-environment a hot batch of wafers is unloaded after completion of processing. As a consequence, the long flexible cable having an isolation mantle and cable guiding means, is regularly exposed to heat radiation. Therefore, the long flexible cable may get heated and outgas, thereby resulting in contamination of the mini-environment and, possibly, contamination of the wafers, which is undesirable. In an attempt to avoid this contamination, the connection through a long flexible cable in a loop was replaced by a connection made through a connector. The connector has a movable connector part mounted on the movable door plate and a fixed connector part. The two connector parts mate and make contact when the door plate is in an upper, sealing position. The cable to the fixed part of the connector can be stationary and has a strongly reduced risk of outgassing and contamination. However, the connector parts, comprising pins that make a sliding movement in sockets during the action of making contact, is appeared to generate particles. Even though the global circulation of filtered air is present in the mini-environment, it appears to be insufficient to prevent the wafers from being contaminated with particles.

SUMMARY

According to an aspect of the present invention, an electrical connector to be used in a mini-environment of a semiconductor processing tool is provided. The electrical connector comprises a male connector part having pins and a first holder in which the pins are mounted; and a female connector part having sockets and a second holder in which the sockets are mounted, wherein the male connector part and the female connector part are configured to mate with each other, wherein circumferential parts of the first holder and the second holder are dimensioned such that when the male connector part and the female connector part approach each other, the circumferential parts of the first holder and the second holder partially overlap and define a gap between the circumferential parts of the first holder and the second holder until the pins are in contacting engagement with the sockets, and the first holder and the second holder cooperatively form a chamber enclosing the pins and sockets, and wherein at least one of the male connector and the female connector is provided with an air extraction conduit of which one end communicates with the chamber and the other end communicates with a vacuum pump.

According to another aspect of the present invention, a method of handling the aforementioned electrical connector is provided. The method comprises disposing the male connector part and the female connector part in a position that the first holder and the second holder overlap each other at least in part; establishing a communication between the chamber and the vacuum pump through the air extraction conduit at least when the pins are in contacting engagement with the sockets, so that an air flow is established through the gap and the chamber in the direction of the vacuum pump to evacuate particles formed by the electrical connector.

According to another aspect of the present invention, an electrical connector of a semiconductor processing tool is provided. The electrical connector comprises a male connector part having pins and a first holder in which the pins are mounted; and a female connector part having sockets and a second holder in which the sockets are mounted, wherein the male connector part is configured to mate with the female connector part and wherein at least one of the male connector part and the female connector part has an air extraction conduit of which one end communicates with a vacuum pump and the other end communicates with a space formed between the male connector part and the female connector part.

DETAILED DESCRIPTION OF THE EMBODIMENTS

Advantages and features of the present invention and methods to achieve them will be elucidated from exemplary embodiments described below in detail with reference to the accompanying drawings. However, the present invention is not limited to exemplary embodiment disclosed herein but may be implemented in various forms. The exemplary embodiments are provided by way of example only so that a person of ordinary skill in the art can fully understand the disclosures of the present invention and the scope of the present invention. Therefore, the present invention will be defined only by the scope of the appended claims.

Provided is an electrical connector to be used in a mini-environment of a semiconductor processing tool such as vertical furnace. An exemplary embodiment of the invention will be explained with reference to the drawings.

Figure 1:
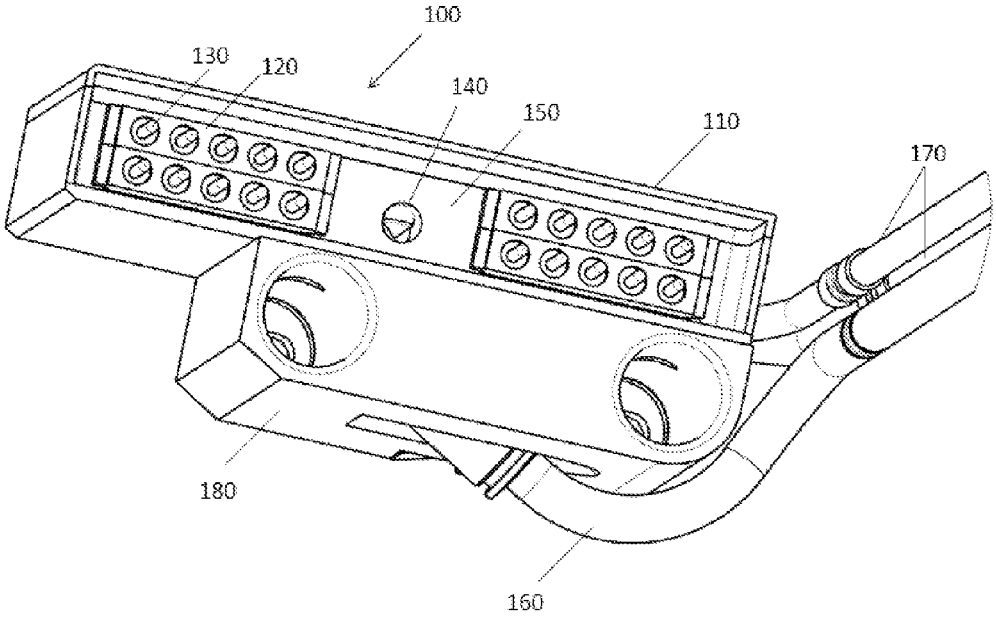
FIG. 1 is a perspective view of a male connector part according to an exemplary embodiment of the present invention.

FIG. 1 is a perspective view of a male connector part according to an exemplary embodiment of the present invention.

Figure 2:
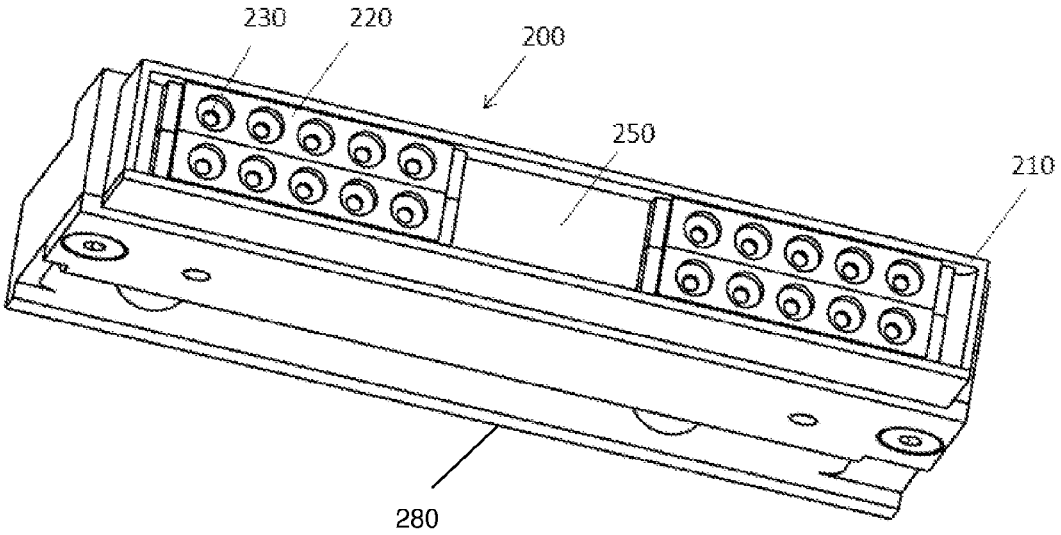
FIG. 2 is a perspective view of a female connector part according to an exemplary embodiment of the present invention.

The male connector 100 is provided with a holder 110. Pin blocks 120 with arrays of pins 130 are mounted in the holder 110. An air extraction conduit 140 is provided at the center of the holder 110. One end of the air extraction conduit 140 communicates with a chamber space 150 provided between the pin blocks 120 in the holder 110. The other end of the air extraction conduit 140 is in communication with a vacuum pump (not shown) through a tube 160. Electrical connections to sources of electrical energy or to control devices are made through one or more cables 170. The male connector 100 is mounted, through mounting base 180 on a substantially stationary part of the processing tool FIG. 2 is a perspective view of a female connector part according to an exemplary embodiment of the present invention.

The female connector 200 is provided with a holder 210. Socket blocks 220 with arrays of sockets 230 are mounted in the holder 210. A chamber space 250 is provided between the socket blocks 220 in the center of the holder 210. The female connector 200 is mounted through bracket 280 on a movable part of the processing tool.

The male connector 100 and the female connector 200 are configured to be able to mate with each other. This implies that each of the pins 130 is able to mate with a corresponding socket 230 and the connector holders 100 and 200 are able to mate with each other.

Figure 3:
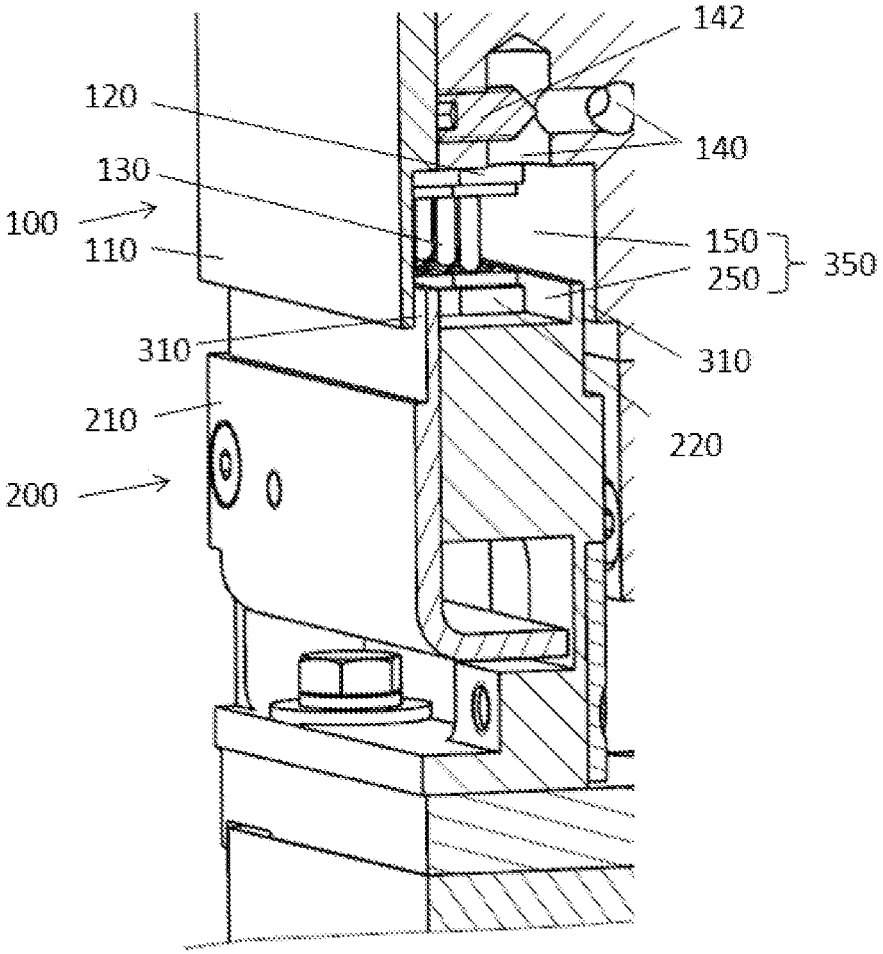
FIG. 3 is a perspective view of a connector according to an exemplary embodiment of the present invention showing a male and female connector parts in a position that pins of the male connector part start to engage sockets of the female connector part.

FIG. 3 is a perspective view of a connector according to an exemplary embodiment of the present invention showing a male and female connector parts in a position wherein pins of the male connector part start to engage sockets of the female connector part. Similar parts are indicated with the same reference numerals as in FIGS. 1 and 2. The chamber spaces 150 and 250 are positioned opposite to each other and form a common chamber space. The air extraction conduit 140 may have a plurality of parts, e.g. vertical and horizontal parts. An adjustment screw 142 is provided at an intermediate portion of the air extraction conduit 140 so as to adjust the suction amount through the air extraction conduit 140. One end the air extraction conduit 140 is in communication with the chamber spaces 150, 250. The other end of the air extraction conduit 140 is in communication with a vacuum pump. The air extraction conduit 140 may be provided in the female connector 200 instead of the male connector 100. The air extraction conduit 140 may be provided in both the male connector 100 and the female connector 200.

Circumferential portions of the holders 110 and 210 are dimensioned such that, in an approaching position of the male and female connectors 100 and 200, the circumferential portions of the holders 110 and 210 partially overlap and form a narrow gap 310 between them before the pins 130 are contacting the sockets 230. In this position, the holders 110 and 210 form a chamber 350 that combines and unites the chamber spaces 150 and 250. Air may be pulled out from the mini-environment space around the connectors 100 and 200, through successively the gap 310, the chamber 350, and the air extraction conduit 140 to the vacuum pump. When the male and female connectors 100 and 200 further approach each other, the pins 130 slide in and contact the sockets 230 and the pins 130 are inserted into the sockets 230 over some distance until the male and female connectors 100 and 200 are in fully mating position. The overlapping length of the circumferential parts of the holders 110 and 210 correspondingly increases. Air extraction may be applied at least over the entire time span in which the pins 130 are in contacting engagement with and slide into the sockets 230 during both the male and female connectors 100 and 200 close or open actions. The pins 130 are said to be in contacting engagement with the sockets 230, when at least portions (end tips) of the pins 130 are inserted into the sockets 230.

A valve may be provided in the path of the air extraction conduit 140 to the vacuum pump. The valve is in an open position so as to establishing a communication between the chamber and the vacuum pump through the air extraction conduit and established an air flow through the gap and the chamber in the direction of the vacuum pump to evacuate particles formed by the electrical connector at least when the male and female connectors 100 and 200 are moving relative to each other and the pins 130 are engaging with the sockets 230. The valve may be in a closed position to as to remove communication between the chamber and the vacuum pump when the male and female connectors 100 and 200 are in fully mating position and the male and female connectors 100 and 200 do not move relative to each other, or when the male and female connectors 100 and 200 are completely separated such that the pins 130 are not engaged with the sockets 230 at all.

According to an exemplary embodiment of the present invention, a connector having electrical connections of the moving part that is able to avoid contamination of the wafers is provided.

Although throughout this disclosure the word "air" has been used, whether or not in combination with other words such as "air extraction", "air extraction conduit" etc., it will be understood that the minienvironment may comprise another medium such as filtered nitrogen or forming gas or another inert gas and the word "air" is intended to include such alternative gaseous media.

In an embodiment, the substantially stationary part of the connector may be mounted spring loaded, so as to ensure that the connector parts can be pressed into a fully mating position.

It will be apparent to those skilled in the art that various modifications and variations can be made in the present invention without departing from the scope or spirit of the invention. Thus, it is intended that the present invention cover the modifications and variations of this invention provided that they come within the scope of the appended claims or their equivalents.

What is claimed is:

1. An electrical connector to be used in a mini-environment of a semiconductor processing tool, comprising:

a male connector part having pins and a first holder in which the pins are mounted; and a female connector part having sockets and a second holder in which the sockets are mounted, wherein the male connector part and the female connector part are configured to mate with each other, wherein circumferential parts of the first holder and the second holder are dimensioned such that when the male connector part and the female connector part approach each other, the circumferential parts of the first holder and the second holder overlap and define a gap between the circumferential parts of the first holder and the second holder and the first holder and the second holder cooperatively form a chamber enclosing the pins and sockets, at least when the pins are in contacting engagement with the sockets, wherein at least one of the male connector and the female connector is provided with an air extraction conduit of which one end communicates with the chamber and the other end communicates with a vacuum pump, and wherein either the male connector part or the female connector part is mounted to be substantially fixed on the semiconductor processing tool, connected to electrical feeds, and provided with the air extraction conduit.

2. The connector of claim 1 wherein the male connector part is mounted to be substantially fixed on the semiconductor processing tool.

3. The connector of claim 1 wherein the female connector part is mounted to be substantially fixed on the semiconductor processing tool.

4. A method of handling an electrical connector of claim 1, comprising:

disposing the male connector part and the female connector part in a position that the first holder and the second holder overlap each other at least in part and the first holder and the second holder cooperatively form a chamber enclosing the pins and sockets;

establishing a communication between the chamber and the vacuum pump through the air extraction conduit at least when the pins are in contacting engagement with the sockets, so that an air flow is established through the gap and the chamber in the direction of the vacuum pump to evacuate particles formed by the electrical connector, wherein the communication between the chamber and the vacuum pump is removed when the male connector part and female connector part are in fully mating position and the male connector part and female connector part do not move relative to each other.

5. An electrical connector to be used in a mini-environment of a semiconductor processing tool, comprising:

a male connector part having pins and a first holder in which the pins are mounted;

a female connector part having sockets and a second holder in which the sockets are mounted, wherein the male connector part and the female connector part are configured to mate with each other, wherein circumferential parts of the first holder and the second holder are dimensioned such that when the male connector part and the female connector part approach each other, the circumferential parts of the first holder and the second holder overlap and define a gap between the circumferential parts of the first holder and the second holder and the first holder and the second holder cooperatively form a chamber enclosing the pins and sockets, at least when the pins are in contacting engagement with the sockets, wherein at least one of the male connector and the female connector is provided with an air extraction conduit of which one end communicates with the chamber and the other end communicates with a vacuum pump; and a valve provided on a portion of the air extraction conduit.

6. An electrical connector to be used in a mini-environment of a semiconductor processing tool, comprising:

a male connector part having pins and a first holder in which the pins are mounted; and a female connector part having sockets and a second holder in which the sockets are mounted, wherein the male connector part and the female connector part are configured to mate with each other, wherein circumferential parts of the first holder and the second holder are dimensioned such that when the male connector part and the female connector part approach each other, the circumferential parts of the first holder and the second holder overlap and define a gap between the circumferential parts of the first holder and the second holder and the first holder and the second holder cooperatively form a chamber enclosing the pins and sockets, at least when the pins are in contacting engagement with the sockets, wherein at least one of the male connector and the female connector is provided with an air extraction conduit of which one end communicates with the chamber and the other end communicates with a vacuum pump, and wherein the pins are arranged on first blocks and the sockets are arranged on second blocks.

7. The connector of claim 6, wherein the first blocks are disposed on both sides of the first holder with a center space between the first blocks.

8. The connector of claim 7, wherein the second blocks are disposed on both sides of the second holder with a center space between the second blocks.

9. An electrical connector of a semiconductor processing tool, comprising:

a male connector part having pins and a first holder in which the pins are mounted; and a female connector part having sockets and a second holder in which the sockets are mounted, wherein the male connector part is configured to mate with the female connector part, wherein at least one of the male connector part and the female connector part has an air extraction conduit of which one end communicates with a vacuum pump and the other end communicates with a space formed between the male connector part and the female connector part, wherein when a circumferential part of the first holder overlaps a circumferential part of the second holder, a gap is defined between the circumferential part of the first holder and the circumferential part of the second holder to allow air flow, wherein the pins are arranged on first blocks and the sockets are arranged on second blocks, wherein the first blocks are disposed on both sides of the first holder with a first center space between the first blocks and wherein the second blocks are disposed on both sides of the second holder with a second center space between the second blocks.

10. The connector of claim 9, wherein the other end of the air extraction conduit is disposed in one of the first center space and the second center space.

* * * * *